US011187447B2

(12) United States Patent
Koike et al.

(10) Patent No.: US 11,187,447 B2
(45) Date of Patent: Nov. 30, 2021

(54) REFRIGERATION CYCLE APPARATUS

(71) Applicant: Mitsubishi Electric Corporation, Tokyo (JP)

(72) Inventors: Takanori Koike, Tokyo (JP); Osamu Morimoto, Tokyo (JP); Kazuyoshi Shinozaki, Tokyo (JP); Hiroyuki Okano, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 15/779,663

(22) PCT Filed: Jan. 27, 2016

(86) PCT No.: PCT/JP2016/052313

§ 371 (c)(1),
(2) Date: May 29, 2018

(87) PCT Pub. No.: WO2017/130319

PCT Pub. Date: Aug. 3, 2017

(65) Prior Publication Data

US 2018/0328639 A1 Nov. 15, 2018

(51) Int. Cl.
*F25B 49/02* (2006.01)
*F25B 13/00* (2006.01)
(Continued)

(52) U.S. Cl.
CPC ..... *F25B 49/02* (2013.01); *F25B 13/00* (2013.01); *F25B 30/02* (2013.01); *F25B 41/31* (2021.01);
(Continued)

(58) Field of Classification Search
CPC ..... F25B 49/02; F25B 45/022; F25B 13/00; F25B 30/02
See application file for complete search history.

(56) References Cited

U.S. PATENT DOCUMENTS 2,694,904 A * 11/1954 Lange ..... F25B 47/022 62/198
4,209,996 A * 7/1980 Shaw ..... F24D 11/0221 62/175
(Continued)

FOREIGN PATENT DOCUMENTS

JP 2008-057875 A 3/2008
JP 2015-075258 A 4/2015
WO 2011/077720 A1 6/2011

OTHER PUBLICATIONS

International Search Report of the International Searching Authority dated Apr. 26, 2016 for the corresponding International application No. PCT/JP2016/052313 (and English translation).
(Continued)

*Primary Examiner* — Larry L Furdge
*Assistant Examiner* — Alexis K Cox
(74) *Attorney, Agent, or Firm* — Posz Law Group, PLC

(57) ABSTRACT

A refrigeration cycle apparatus includes a refrigerant circuit, through which refrigerant is circulated, including a compressor, a heat source side heat exchanger, a first expansion device, and a load side heat exchanger, a controller controlling the refrigerant circuit, and a bypass pipe that branches off from a high-pressure pipe extending from the compressor to the first expansion device and that is connected to a low-pressure pipe on a suction side of the compressor. The apparatus further includes a precooling heat exchanger that is provided in the bypass pipe and that cools the refrigerant diverted to the bypass pipe, a second expansion device that is provided in the bypass pipe and that reduces a pressure of the refrigerant cooled by the precooling heat exchanger, and a refrigerant cooler that is provided in the bypass pipe and that cools the controller with the refrigerant reduced in pressure by the second expansion device.

11 Claims, 10 Drawing Sheets

(51) Int. Cl.
*F25B 41/31* (2021.01)
*F25B 30/02* (2006.01)

(52) U.S. Cl.
CPC . *F25B 2313/021* (2013.01); *F25B 2313/0233* (2013.01); *F25B 2313/02741* (2013.01); *F25B 2600/2513* (2013.01); *F25B 2700/21153* (2013.01)

(56) References Cited

U.S. PATENT DOCUMENTS

2002/0092318 A1* 7/2002 Tipton ..... F25B 39/02 62/510
2002/0157409 A1* 10/2002 Pham ..... F25B 1/04 62/228.3
2004/0089015 A1* 5/2004 Knight ..... F24F 3/153 62/324.1
2004/0095097 A1* 5/2004 Oglesbee ..... H02J 7/0029 320/150
2004/0177631 A1* 9/2004 Lifson ..... F25B 41/04 62/197
2005/0223726 A1* 10/2005 Lifson ..... F25B 6/02 62/196.2
2010/0251761 A1* 10/2010 Yoshimi ..... F25B 13/00 62/524
2010/0300141 A1* 12/2010 Fujimoto ..... F25B 1/10 62/498
2011/0030409 A1* 2/2011 Fujimoto ..... F25B 1/10 62/324.6
2012/0255318 A1 10/2012 Kido et al.
2013/0118707 A1* 5/2013 Kardos ..... H01M 10/6568 165/42
2014/0238062 A1* 8/2014 Sul ..... F25B 47/022 62/228.2
2014/0345311 A1* 11/2014 Sun ..... F25B 31/006 62/259.2
2016/0238285 A1* 8/2016 Kawano ..... F25B 13/00
2017/0167761 A1* 6/2017 Ikeda ..... F25B 41/04

OTHER PUBLICATIONS

Office Action dated Jul. 2, 2019 issued in corresponding JP patent application No. 2017-563450 (and English translation).

* cited by examiner

REFRIGERATION CYCLE APPARATUS

CROSS REFERENCE TO RELATED APPLICATION

This application is a U.S. national stage application of International Application No. PCT/JP2016/052313, filed on Jan. 27, 2016, the contents of which are incorporated herein by reference.

TECHNICAL FIELD

The present invention relates to a refrigeration cycle apparatus including a cooling mechanism for a controller.

BACKGROUND

For cooling of a controller, a known technique involves diverting part of refrigerant, serving as a high-pressure side main stream flowing through a refrigerant circuit, to a bypass pipe, allowing the refrigerant flowing through the bypass pipe to transfer heat in a precooling heat exchanger, and allowing the refrigerant that has transferred heat to flow through a refrigerant cooler and exchange heat with a controller to cool the controller (refer to Patent Literature 1, for example). The part of the refrigerant, serving as the high-pressure side main stream, diverted to the bypass pipe cools the controller in the refrigerant cooler. After that, the refrigerant flowing through the bypass pipe passes through an expansion device, which adjusts the flow rate of the refrigerant through the refrigerant cooler, and flows to a low-pressure side.

PATENT LITERATURE

Patent Literature 1: Japanese Unexamined Patent Application Publication No. 2015-75258

As described in Patent Literature 1, the flow rate of the refrigerant through the refrigerant cooler is adjusted by the expansion device located downstream of the refrigerant cooler. Disadvantageously, this technique fails to provide a sufficient difference in temperature between the controller and the refrigerant in the refrigerant cooler because the refrigerant in the refrigerant cooler is at a high pressure and its evaporating temperature accordingly increases. Consequently, if a large cooling capacity is required, the required cooling capacity fails to be achieved. To achieve the required cooling capacity, a large amount of refrigerant has to be diverted to the bypass pipe. This leads to a reduction in capacity of the refrigeration cycle apparatus.

SUMMARY

The present invention has been made to overcome the above-described disadvantages and aims to provide a refrigeration cycle apparatus capable of improving the performance of cooling a controller.

A refrigeration cycle apparatus according to an embodiment of the present invention includes a refrigerant circuit, through which refrigerant is circulated, including a compressor, a heat source side heat exchanger, a first expansion device, and a load side heat exchanger, a controller controlling the refrigerant circuit, and a bypass pipe that branches off from a high-pressure pipe extending from the compressor to the first expansion device and that is connected to a low-pressure pipe on a suction side of the compressor. The apparatus further includes a precooling heat exchanger that is provided in the bypass pipe and that cools the refrigerant diverted to the bypass pipe, a second expansion device that is provided in the bypass pipe and that reduces a pressure of the refrigerant cooled by the precooling heat exchanger, and a refrigerant cooler that is provided in the bypass pipe and that cools the controller with the refrigerant reduced in pressure by the second expansion device.

According to the embodiment of the present invention, the second expansion device is interposed between the precooling heat exchanger and the refrigerant cooler. The refrigerant cooled through the precooling heat exchanger is reduced in pressure through the second expansion device such that the temperature of the refrigerant is further reduced. Then, the refrigerant is allowed to flow into the refrigerant cooler. Such a configuration can improve the performance of cooling the controller.

DETAILED DESCRIPTION

An air-conditioning apparatus, which is an example of a refrigeration cycle apparatus, will be described below with reference to the drawings, for example. Note that components designated by the same reference signs in FIG. 1 and the following figures are the same components or equivalents. This note applies to Embodiments described below. Furthermore, note that the forms of components described in the specification are intended to be illustrative only and are not intended to be limited to those described in the specification. In addition, high and low values of temperature, pressure, or other parameters are not determined in relation to a particular absolute value, but are relatively determined based on, for example, a state and an operation of, for example, a system or an apparatus.

Embodiment 1

Figure 1:
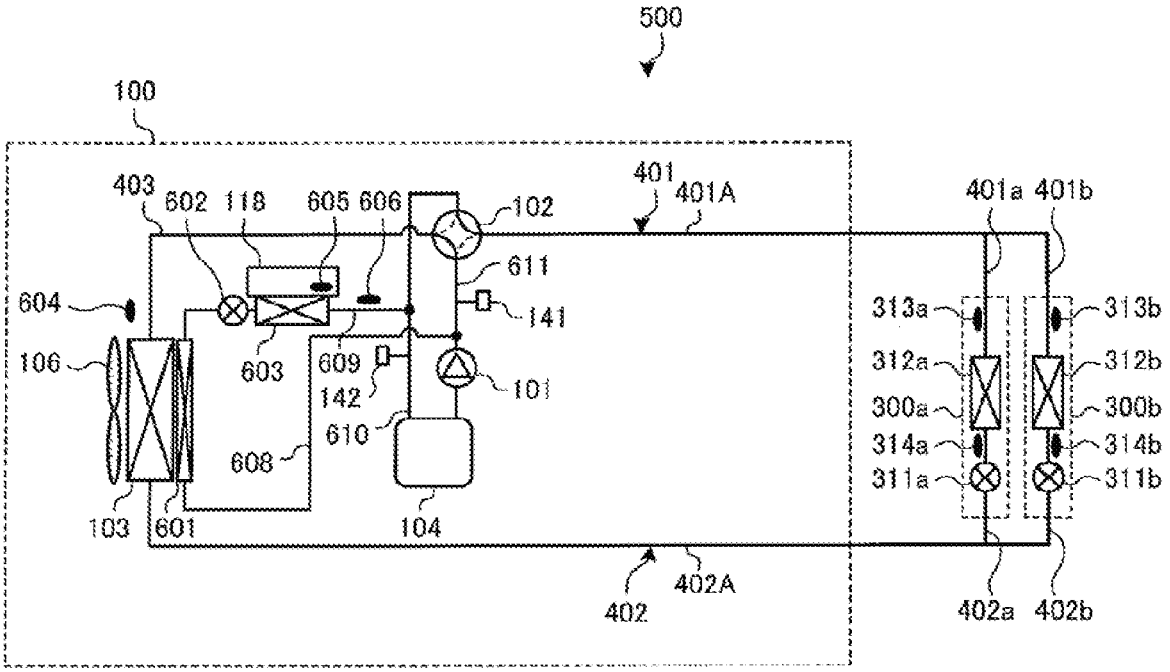
FIG. 1 is a schematic diagram illustrating an exemplary configuration of a refrigerant circuit of an air-conditioning apparatus 500 according to Embodiment 1 of the present invention.

FIG. 1 is a schematic diagram illustrating an exemplary configuration of a refrigerant circuit of an air-conditioning apparatus 500 according to Embodiment 1 of the present invention. A refrigerant flow in a refrigeration cycle will be described before description of refrigerant cooling. The configuration of the refrigerant circuit of the air-conditioning apparatus 500 will be described with reference to FIG. 1. The air-conditioning apparatus 500, which is installed in, for example, a building or a condominium, can perform a cooling operation or a heating operation using a refrigeration cycle (heat pump cycle) through which refrigerant is circulated.

The air-conditioning apparatus 500 includes a heat source side unit 100 and a plurality of (in FIG. 1, two) load side units 300 (a load side unit 300*a* and a load side unit 300*b*). In the air-conditioning apparatus 500, the heat source side unit 100 is connected to the load side units 300 (load side units 300*a* and 300*b*) by a gas extension pipe 401 and a liquid extension pipe 402, thus forming the refrigeration cycle. The gas extension pipe 401 includes a gas main pipe 401A, a gas branch pipe 401*a*, and a gas branch pipe 401*b*. The liquid extension pipe 402 includes a liquid main pipe 402A, a liquid branch pipe 402*a*, and a liquid branch pipe 402*b*.

[Heat Source Side Unit 100]

The heat source side unit 100 has a function of supplying cooling energy or heating energy to the load side units 300.

The heat source side unit 100 includes a compressor 101, a four-way switching valve 102, serving as a flow switching device, a heat source side heat exchanger 103, and an accumulator 104. These devices are connected in series, thus forming part of a main refrigerant circuit. The heat source side unit 100 further includes a heat source side fan 106.

The compressor 101 sucks low-temperature, low-pressure gas refrigerant, compresses the refrigerant into high-temperature, high-pressure gas refrigerant, discharges the refrigerant, and circulates the refrigerant through the refrigerant circuit, thus performing an operation related to air-conditioning. The compressor 101 may be, for example, an inverter-driven compressor whose capacity is controllable. The compressor 101 is not limited to the capacity-controllable inverter-driven compressor. For example, the compressor 101 may be a constant-speed compressor or may be of a combined type of, for example, the inverter-driven compressor and the constant-speed compressor. The compressor 101 may be of any type capable of compressing sucked refrigerant into a high-pressure state. For example, the compressor 101 may be any of a variety of types, such as reciprocal, rotary, scroll, and screw compressors.

The four-way switching valve 102, which is provided on a discharge side of the compressor 101, switches between a refrigerant flow passage for the cooling operation and a refrigerant flow passage for the heating operation. The four-way switching valve 102 controls a flow of the refrigerant so that the heat source side heat exchanger 103 functions as an evaporator or a condenser in accordance with an operation mode.

The heat source side heat exchanger 103 exchanges heat between the refrigerant and a heat medium (e.g., ambient air or water). In the heating operation, the heat source side heat exchanger 103 functions as an evaporator to evaporate and gasify the refrigerant. In the cooling operation, the heat source side heat exchanger 103 functions as a condenser (radiator) to condense and liquefy the refrigerant.

In the case where the heat source side heat exchanger 103 is an air-cooled heat exchanger as in Embodiment 1, the heat source side unit 100 includes an air-sending device, for example, the heat source side fan 106. To control a condensing capacity or an evaporating capacity of the heat source side heat exchanger 103, for example, a controller 118, which will be described later, adjusts the rotation speed of the heat source side fan 106. In the case where the heat source side heat exchanger 103 is a water-cooled heat exchanger, the rotation speed of a water circulating pump (not illustrated) is adjusted to control the condensing capacity or the evaporating capacity of the heat source side heat exchanger 103.

The accumulator 104, which is provided on a suction side of the compressor 101, has a function of separating liquid refrigerant from gas refrigerant and a function of storing an excess of refrigerant.

The heat source side unit 100 further includes a high-pressure sensor 141 that detects the pressure (high-pressure side pressure) of the refrigerant discharged from the compressor 101. In addition, the heat source side unit 100 includes a low-pressure sensor 142 that detects the pressure (low-pressure side pressure) of the refrigerant to be sucked into the compressor 101. The heat source side unit 100 further includes an outdoor air temperature sensor 604 that detects the temperature of outdoor air, a controller temperature sensor 605 that detects the temperature of the controller 118, and a temperature sensor 606 that detects the temperature of a pipe located downstream of a refrigerant cooler 603. These sensors each transmit a signal indicating the detected pressure or the detected temperature to the controller 118 controlling an operation of the air-conditioning apparatus 500.

The controller 118 controls, for example, the driving frequency of the compressor 101, the rotation speed of the heat source side fan 106, and switching of the four-way switching valve 102 on the basis of the high-pressure side pressure and the low-pressure side pressure. In addition, the controller 118 controls an expansion device 602, which will be described later, on the basis of the pressures and temperatures detected by the respective sensors. The temperature sensor 606 and the low-pressure sensor 142 constitute a superheat-degree detection device in the present invention. The superheat-degree detection device has only to detect the degree of superheat at an outlet of the refrigerant cooler 603. A temperature sensor that detects the temperature of the refrigerant at an inlet of the refrigerant cooler 603 may be used instead of the low-pressure sensor 142.

The controller 118 controls the devices included in the heat source side unit 100 in a centralized manner to control the air-conditioning apparatus 500. The controller 118 includes a microcomputer. The controller 118 includes a control arithmetic processing unit, such as a central processing unit (CPU). The controller 118 further includes a storage unit (not illustrated), which stores data on a program for a process related to, for example, control. The control arithmetic processing unit executes the process based on the program data, thus achieving control of, for example, the devices included in the heat source side unit 100. Although the controller 118 is provided in the heat source side unit 100 in Embodiment 1, the controller 118 may be provided at any location as long as the controller 118 can control the devices, for example.

The heat source side unit 100 further includes a bypass pipe 608 that branches off from a high-pressure pipe 611 through which the high-pressure gas refrigerant discharged from the compressor 101 flows and that is connected to a low-pressure pipe 610 on the suction side of the compressor 101. The bypass pipe 608 is used to divert the high-pressure gas refrigerant, serving as a main stream. In the bypass pipe 608, a precooling heat exchanger 601 is provided to cool the high-pressure gas refrigerant that has flowed into the bypass pipe 608. The expansion device 602 that adjusts the flow rate through the bypass pipe and the refrigerant cooler 603 that cools the controller 118 are arranged downstream of the precooling heat exchanger 601. The expansion device 602 corresponds to a second expansion device in the present invention.

The expansion device 602, functioning as a pressure reducing valve or an expansion valve, reduces the pressure of the refrigerant to expand the refrigerant. The expansion device 602 has the function of reducing the pressure of the high-pressure refrigerant cooled by the precooling heat exchanger 601 to further reduce the temperature of the refrigerant and allowing the temperature-reduced refrigerant to flow into the refrigerant cooler 603. The expansion device 602 includes a component whose opening degree is variably adjustable, such as an electronic expansion valve.

The precooling heat exchanger 601 is integrated with the heat source side heat exchanger 103 into a single integrated heat exchanger. Part of the integrated heat exchanger serves as the precooling heat exchanger 601. The precooling heat exchanger 601 may be a component separate from the heat source side heat exchanger 103.

The refrigerant cooler 603 includes a refrigerant pipe, through which the refrigerant flows, such that the refrigerant pipe is in contact with the controller 118. The refrigerant that has flowed into the bypass pipe 608 is cooled by the precooling heat exchanger 601 such that the refrigerant turns into liquid refrigerant. The liquid refrigerant is subjected to flow rate adjustment by the expansion device 602 and then flows into the refrigerant cooler 603. The liquid refrigerant that has flowed into the refrigerant cooler 603 receives heat radiated from the controller 118, so that the refrigerant turns into gas refrigerant. The gas refrigerant flows through a refrigerant-cooler downstream pipe 609, located downstream of the refrigerant cooler 603, and the low-pressure pipe 610 to the accumulator 104.

[Load Side Units 300]

The load side units 300 supply cooling energy or heating energy from the heat source side unit 100 to a cooling load or a heating load. For example, as illustrated in FIG. 1, each component included in the "load side unit 300*a*" has a letter "a" after its reference sign, and each component included in the "load side unit 300*b*" has a letter "b" after its reference sign. Although the letter "a" or "b" after the reference sign may be omitted in the following description, the load side unit 300*a* and the load side unit 300*b* include those components.

Each of the load side units 300 includes a load side heat exchanger 312 (load side heat exchanger 312*a*, 312*b*) and an expansion device 311 (expansion device 311*a*, 311*b*) such that the load side heat exchanger 312 and the expansion device 311 are connected in series. The load side unit 300 and the heat source side unit 100 are included in the refrigerant circuit. The expansion device 311 corresponds to a first expansion device in the present invention. The load side unit 300 may further include an air-sending device (not illustrated) for supplying air to the load side heat exchanger 312. The load side heat exchanger 312 may exchange heat between the refrigerant and a heat medium different from the refrigerant, for example, water.

The load side heat exchanger 312 exchanges heat between the heat medium (e.g., ambient air or water) and the refrigerant. In the heating operation, the load side heat exchanger 312 functions as a condenser (radiator) to condense and liquefy the refrigerant. In the cooling operation, the load side heat exchanger 312 functions as an evaporator to evaporate and gasify the refrigerant. The load side heat exchanger 312 is typically used in combination with an air-sending device, whose depiction is omitted. The rotation speed of the air-sending device is used to control the condensing capacity or the evaporating capacity of the load side heat exchanger 312.

The expansion device 311, functioning as a pressure reducing valve or an expansion valve, reduces the pressure of the refrigerant to expand the refrigerant. The expansion device 311 may include a component whose opening degree is variably adjustable, for example, an accurate flow control device, such as an electronic expansion valve, or an inexpensive refrigerant flow control unit, such as a capillary tube.

The load side unit 300 includes at least a temperature sensor 314 (temperature sensor 314*a*, 314*b*) that detects the temperature of a refrigerant pipe between the expansion device 311 and the load side heat exchanger 312 and a temperature sensor 313 (temperature sensor 313*a*, 313*b*) that detects the temperature of the refrigerant pipe between the load side heat exchanger 312 and the four-way switching valve 102. Information (temperature information) obtained by such detection units is transmitted to the controller 118 controlling the operation of the air-conditioning apparatus 500 and is used to control various actuators. In other words, the information from the temperature sensor 313 and the temperature sensor 314 is used to adjust, for example, the opening degree of the expansion device 311 included in the load side unit 300 and the rotation speed of the air-sending device, whose depiction is omitted.

The refrigerant used in the air-conditioning apparatus 500 may be of any type. For example, any of natural refrigerants, such as carbon dioxide, hydrocarbon, and helium, chlorine-free alternate refrigerants, such as HFC-410A, HFC-407C, and HFC-404A, and chlorofluorocarbon refrigerants, such as R-22 and R-134a, used in existing products may be used.

Although the configuration in which the controller 118 controlling the operation of the air-conditioning apparatus 500 is provided in the heat source side unit 100 is illustrated as an example in FIG. 1, the controller 118 may be provided in any of the load side units 300. Furthermore, the controller 118 may be provided outside the heat source side unit 100 and the load side units 300. In addition, the controller 118 may be divided into a plurality of controllers on the basis of functions, and the controller may be provided in each of the heat source side unit 100 and the load side units 300. In this case, the controllers may be connected to each other in a wireless or wired manner for communication.

Operations performed by the air-conditioning apparatus 500 will now be described.

The air-conditioning apparatus 500 receives a cooling request or a heating request from, for example, a remote controller provided in, for example, an indoor space. The air-conditioning apparatus 500 performs an air-conditioning operation in any of two operation modes in response to the request. The two operation modes are a cooling operation mode and a heating operation mode.

[Cooling Operation Mode]

Figure 2:
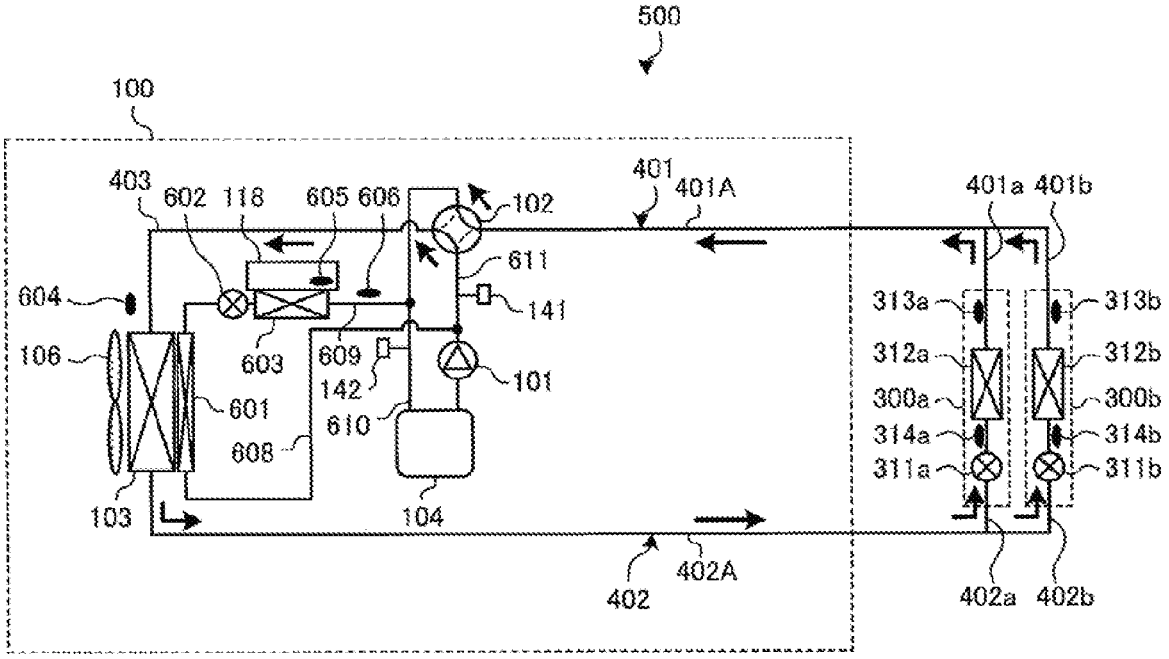
FIG. 2 is a diagram illustrating a flow of refrigerant in a cooling operation mode of the air-conditioning apparatus 500 according to Embodiment 1 of the present invention.

FIG. 2 is a diagram illustrating a flow of the refrigerant in the cooling operation mode of the air-conditioning apparatus 500 according to Embodiment 1 of the present invention. An operation of the air-conditioning apparatus 500 in the cooling operation mode will now be described with reference to FIG. 2.

The compressor 101 compresses low-temperature, low-pressure refrigerant into high-temperature, high-pressure gas refrigerant and discharges the refrigerant. The high-temperature, high-pressure gas refrigerant discharged from the compressor 101 passes through the four-way switching valve 102, and flows to the heat source side heat exchanger 103. Since the heat source side heat exchanger 103 functions as a condenser, the refrigerant exchanges heat with the ambient air and thus condenses and liquefies. The liquid refrigerant leaving the heat source side heat exchanger 103 flows through the liquid main pipe 402A, and flows out of the heat source side unit 100.

The high-pressure liquid refrigerant leaving the heat source side unit 100 flows through the liquid branch pipes 402*a* and 402*b*, and flows into the load side units 300*a* and 300*b*. The liquid refrigerant that has flowed into the load side units 300*a* and 300*b* is throttled into low-temperature, two-phase gas-liquid refrigerant by the expansion devices 311*a* and 311*b*. The low-temperature, two-phase gas-liquid refrigerant flows into the load side heat exchangers 312*a* and 312*b*. Since the load side heat exchangers 312*a* and 312*b* each function as an evaporator, the refrigerant exchanges heat with the ambient air and thus evaporates and gasifies. At this time, the refrigerant removes heat from the ambient air, thus cooling the indoor space. After that, the refrigerant leaving the load side heat exchangers 312*a* and 312*b* flows through the gas branch pipes 401*a* and 401*b*, and flows out of the load side units 300*a* and 300*b*.

The refrigerant leaving the load side units 300*a* and 300*b* flows through the gas main pipe 401A, and returns to the heat source side unit 100. The gas refrigerant that has returned to the heat source side unit 100 passes through the four-way switching valve 102 and the accumulator 104, and is again sucked into the compressor 101. The above-described flow allows the air-conditioning apparatus 500 to implement the cooling operation mode.

[Heating Operation Mode]

Figure 3:
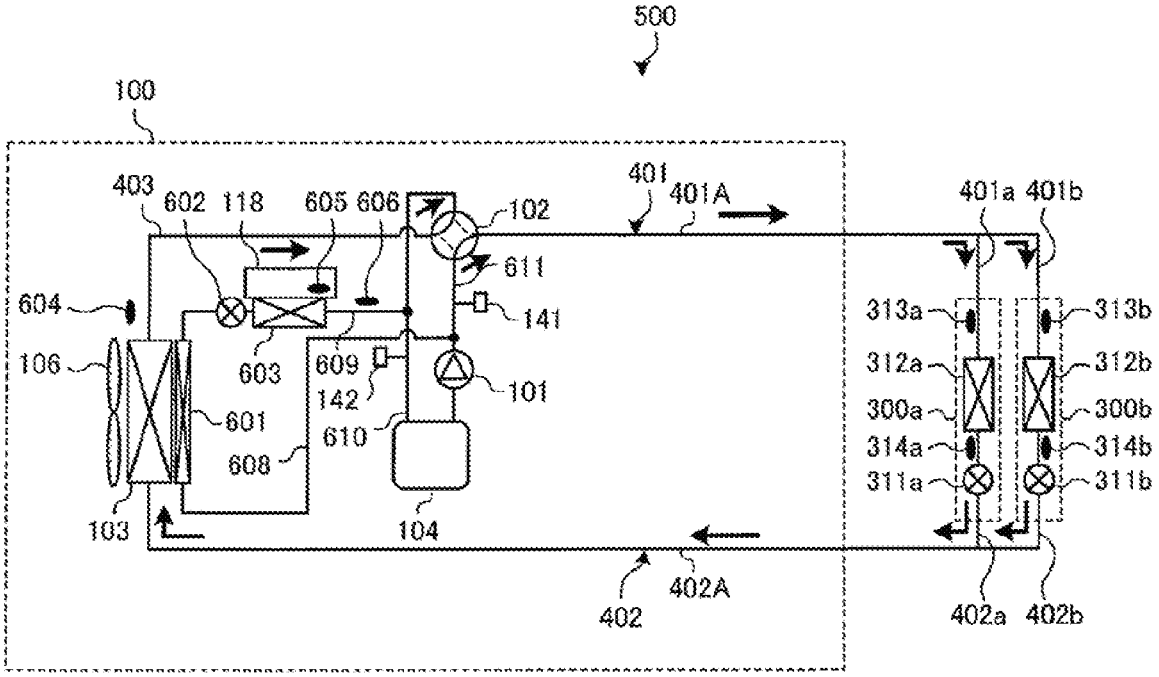
FIG. 3 is a refrigerant circuit diagram illustrating a flow of the refrigerant in a heating operation mode of the air-conditioning apparatus 500 according to Embodiment 1 of the present invention.

FIG. 3 is a refrigerant circuit diagram illustrating a flow of the refrigerant in the heating operation mode of the air-conditioning apparatus 500 according to Embodiment 1 of the present invention. An operation of the air-conditioning apparatus 500 in the heating operation mode will now be described with reference to FIG. 3.

The compressor 101 compresses low-temperature, low-pressure refrigerant into high-temperature, high-pressure gas refrigerant and discharges the refrigerant. The high-temperature, high-pressure gas refrigerant discharged from the compressor 101 passes through the four-way switching valve 102, and flows to a gas main pipe 401A. After that, the refrigerant flows out of the heat source side unit 100. The high-temperature, high-pressure gas refrigerant leaving the heat source side unit 100 flows through the gas branch pipes 401*a* and 401*b*, and flows into the load side units 300*a* and 300*b*.

The gas refrigerant that has flowed into the load side units 300*a* and 300*b* flows into the load side heat exchangers 312*a* and 312*b*. Since the load side heat exchangers 312*a* and 312*b* each function as a condenser, the refrigerant exchanges heat with the ambient air and thus condenses and liquefies. At this time, the refrigerant transfers heat to the ambient air, thus heating the indoor space, which serves as an air-conditioned space. After that, the liquid refrigerant leaving the load side heat exchangers 312*a* and 312*b* is reduced in pressure by the expansion devices 311*a* and 311*b*. The refrigerant flows through the liquid branch pipes 402*a* and 402*b*, and flows out of the load side units 300*a* and 300*b*.

The refrigerant leaving the load side units 300*a* and 300*b* flows through the liquid main pipe 402A, and returns to the heat source side unit 100. The gas refrigerant that has returned to the heat source side unit 100 flows into the heat source side heat exchanger 103. Since the heat source side heat exchanger 103 functions as an evaporator, the refrigerant exchanges heat with the ambient air and thus evaporates and gasifies. After that, the refrigerant leaving the heat source side heat exchanger 103 passes through the four-way switching valve 102, and flows into the accumulator 104. The compressor 101 sucks the refrigerant in the accumulator 104 and circulates the refrigerant through the refrigerant circuit, thus establishing the refrigeration cycle. The above-described flow allows the air-conditioning apparatus 500 to implement the heating operation mode.

[Refrigerant Cooling Control]

Refrigerant cooling control, serving as a feature of Embodiment 1, will now be described.

The refrigerant cooling control, serving as control for cooling the controller 118 with the refrigerant, is performed in the same manner in both the cooling operation mode and the heating operation mode. For this reason, the refrigerant cooling control will be described below with reference to a diagram illustrating a flow of the refrigerant in the cooling operation mode.

Figure 4:
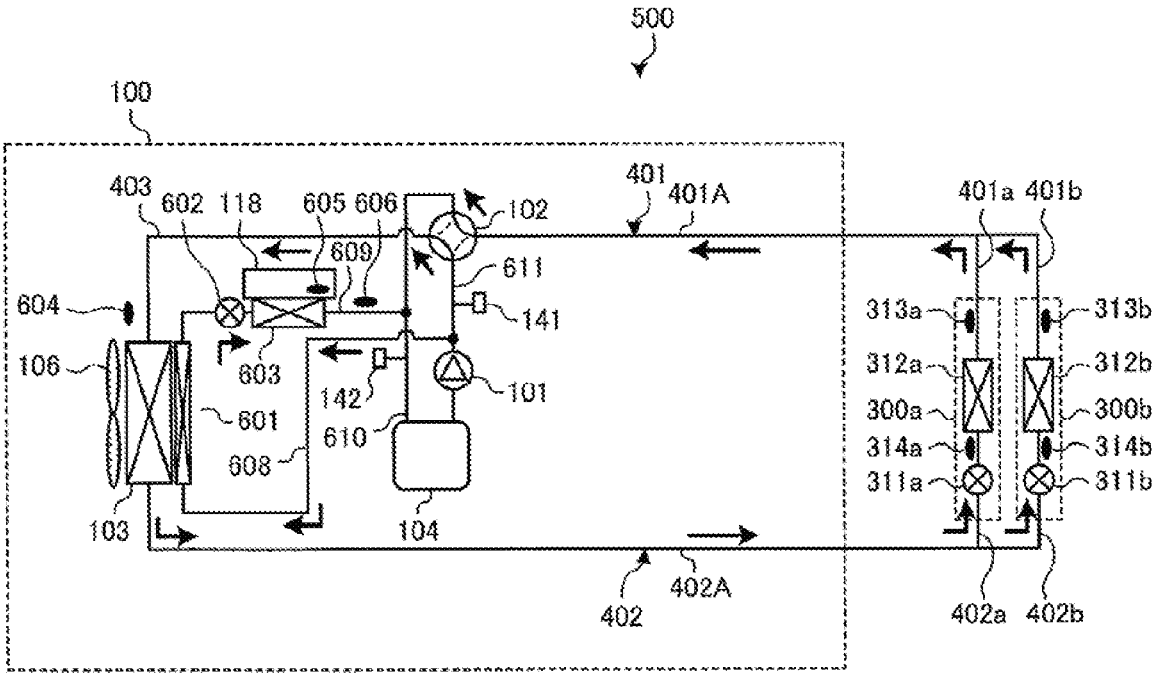
FIG. 4 is a refrigerant circuit diagram illustrating a flow of the refrigerant for refrigerant cooling control in the cooling operation mode of the air-conditioning apparatus 500 according to Embodiment 1 of the present invention.

FIG. 4 is a refrigerant circuit diagram illustrating a flow of the refrigerant for the refrigerant cooling control in the cooling operation mode of the air-conditioning apparatus 500 according to Embodiment 1 of the present invention.

For the refrigerant cooling control, part of the high-pressure gas refrigerant flowing through the high-pressure pipe 611 is diverted to the bypass pipe 608, and flows into the precooling heat exchanger 601. The gas refrigerant that has flowed into the precooling heat exchanger 601 exchanges heat with air sent from the heat source side fan 106, so that the refrigerant is cooled. The liquid refrigerant that has been cooled and reduced to a low pressure in the precooling heat exchanger 601 is further reduced to a lower pressure by the expansion device 602. After that, the refrigerant flows into the refrigerant cooler 603. In the refrigerant cooler 603, the refrigerant exchanges heat with the controller 118 and thus evaporates. At this time, the refrigerant removes heat from the controller 118 and thus cools the controller 118. The refrigerant turns into gas refrigerant or two-phase refrigerant by cooling the controller 118. The refrigerant flows through the low-pressure pipe 610 and flows into the accumulator 104.

The flow rate of the refrigerant through the refrigerant cooler 603 is adjusted by the expansion device 602. The expansion device 602 is controlled based on the information obtained from the low-pressure sensor 142, the controller temperature sensor 605, the temperature sensor 606, and the outdoor air temperature sensor 604 by the controller 118. Specific control of the expansion device 602 will now be described.

Figure 5:
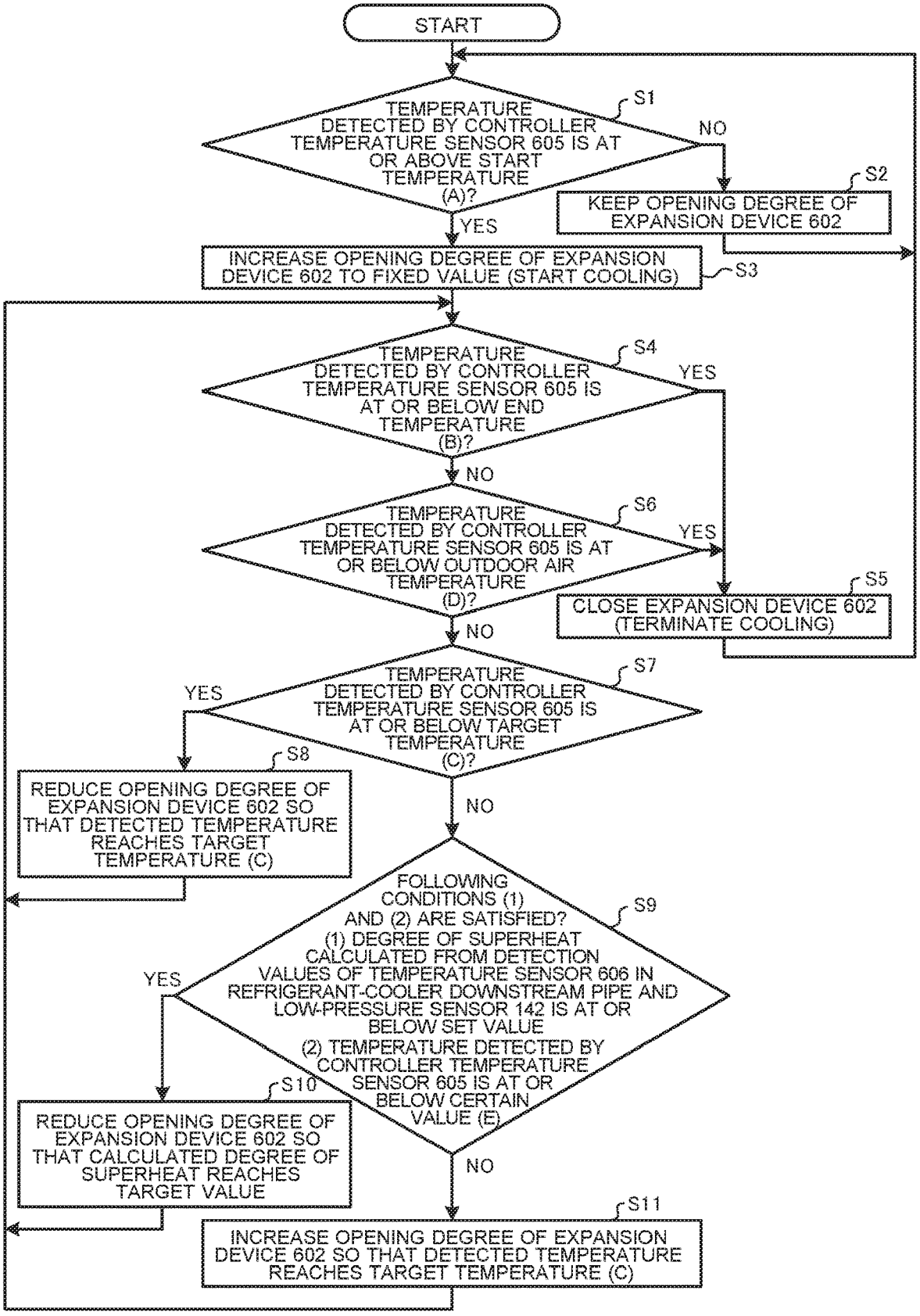
FIG. 5 is a flowchart illustrating control of an expansion device 602 during the refrigerant cooling control in the air-conditioning apparatus 500 according to Embodiment 1 of the present invention.
Figure 6:
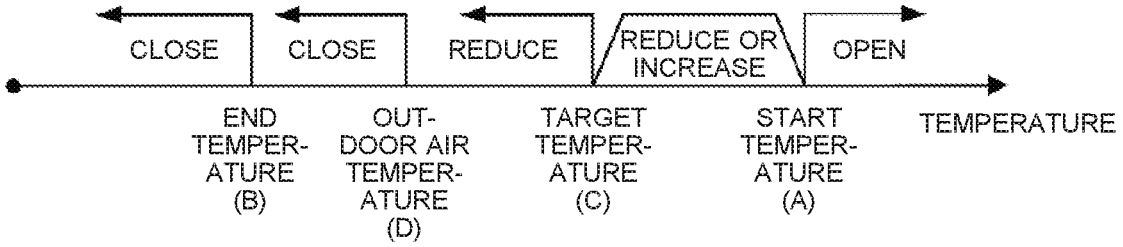
FIG. 6 is a diagram illustrating an operation of the expansion device 602 based on the flowchart of FIG. 5.

FIG. 5 is a flowchart illustrating control of the expansion device 602 during the refrigerant cooling control in the air-conditioning apparatus 500 according to Embodiment 1 of the present invention. FIG. 6 is a diagram illustrating an operation of the expansion device 602 based on the flowchart of FIG. 5. In the following description, it is assumed that temperatures (A) to (E) have the following relation: (B)<(D)<(C)<(E)<(A).

In an initial state, the expansion device 602 is closed. Upon start of the operation of the air-conditioning apparatus 500, the controller 118 determines whether a temperature detected by the controller temperature sensor 605 is at or above a preset start temperature (A) (e.g., 75 degrees C.) (S1). If the detected temperature is below the start temperature (A), it is unnecessary to cool the controller 118, and the opening degree of the expansion device 602 is kept as it is, or kept closed, (S2) to keep the refrigerant from flowing through the refrigerant cooler 603. If the temperature detected by the controller temperature sensor 605 is at or above the start temperature (A), the controller 118 increases the opening degree of the expansion device 602 to a preset fixed value to open the expansion device 602 (S3). Consequently, the refrigerant flows through the refrigerant cooler 603 to start cooling of the controller 118, so that the temperature of the controller 118 decreases.

The controller 118 checks a temperature detected by the controller temperature sensor 605, and determines whether the temperature detected by the controller temperature sensor 605 is at or below a preset end temperature (B) (e.g., 45 degrees C.) (S4). If the temperature detected by the controller temperature sensor 605 is at or below the end temperature (B), the controller 118 closes the expansion device 602 to terminate cooling of the controller 118 (S5). The process returns to step S1. If the temperature detected by the controller temperature sensor 605 is above the end temperature (B), it is necessary to continue cooling, and the controller 118 then determines whether the temperature detected by the controller temperature sensor 605 is at or below an outdoor air temperature (D) (S6). This determination is performed to prevent condensation on the controller 118.

If the temperature detected by the controller temperature sensor 605 falls to the outdoor air temperature (D) or lower, condensation will occur on the controller 118. For this reason, the controller 118 closes the expansion device 602 to terminate cooling of the controller 118 (S5). The process returns to step S1. If the temperature detected by the controller temperature sensor 605 is above the outdoor air temperature (D), the controller 118 then determines whether the temperature detected by the controller temperature sensor 605 is at or below a preset target temperature (C) (e.g., 60 degrees C.) (S7).

If the temperature detected by the controller temperature sensor 605 is at or below the target temperature (C), the controller 118 reduces the opening degree of the expansion device 602 so that the temperature of the controller 118 reaches the target temperature (C) (S8). The process returns to determination in step S4. If the temperature detected by the controller temperature sensor 605 is at the target temperature (C), the present opening degree may be maintained. If the temperature detected by the controller temperature sensor 605 is above the target temperature (C), the controller 118 determines whether both the following conditions (1) and (2) are satisfied (S9).

(1) The degree of superheat, calculated from detection values of the temperature sensor 606 and the low-pressure sensor 142, at the outlet of the refrigerant cooler 603 is at or below a previously set value (e.g., 2 degrees C.).

(2) The temperature detected by the controller temperature sensor 605 is at or below a certain value (E) (e.g., 70 degrees C.).

The determination in step S9 is performed for the following purpose. If the opening degree of the expansion device 602 is adjusted to reduce the temperature detected by the controller temperature sensor 605 to the target temperature (C) or lower and, for example, the flow rate of the refrigerant through the bypass pipe 608 is high relative to the temperature of the controller 118 during the adjustment, the degree of superheat at the outlet of the refrigerant cooler 603 may decrease, leading to liquid back. Specifically, a high flow rate of the refrigerant through the bypass pipe 608 under conditions where the temperature of the controller 118 is not so high may result in an excess of cooling capacity, causing liquid back. The determination on the condition (1) in step S9 is performed to prevent such liquid back.

Fundamentally, if the condition (1) is satisfied and the liquid back is likely to occur as described above, control is performed to reduce the opening degree of the expansion device 602. However, if the temperature of the controller 118 is high and the opening degree is reduced, poor cooling may cause an excessive increase in temperature of the controller 118. For this reason, the condition (2) is provided in addition to the condition (1). If the temperature detected by the controller temperature sensor 605 is not high, control is performed so that the degree of superheat reaches a target value. The condition (2) can be omitted.

Specifically, if both the conditions (1) and (2) are satisfied and cooling is continued, liquid back may occur. For this reason, when determining that both the conditions (1) and (2) are satisfied, the controller 118 reduces the opening degree of the expansion device 602 so that the degree of superheat at the outlet of the refrigerant cooler 603 reaches a target value (S10). The reduction of the opening degree of the expansion device 602 reduces the flow rate of the refrigerant through the bypass pipe 608 to increase the degree of superheat at the outlet of the refrigerant cooler 603, thus preventing liquid back. If either of the conditions (1) and (2) is not satisfied or neither of the conditions (1) and (2) is satisfied, cooling is performed under conditions where liquid back is unlikely to occur. To continue cooling, therefore, the controller 118 increases the opening degree of the expansion device 602 so that the temperature detected by the controller temperature sensor 605 reaches the target temperature (C) (S11). The process returns to step S4, and the same processing steps are repeated.

In the above-described process, if the temperature detected by the controller temperature sensor 605 is within a range above the target temperature (C) and below the start temperature (A), the determination to prevent liquid back is performed in step S9. The reason is as follows. If the detected temperature is outside the above-described range, the degree of superheat will not be at or below the set value, or alternatively, control will be performed to reduce the opening degree of the expansion device 602 as demonstrated in FIG. 6. It is only required that determination in step S9 is performed in the case where the detected temperature is within the above-described range.

The controller 118 is cooled by the above-described refrigerant cooling control. Specific numerical values of the temperatures in the above description are illustrative only, and these values may be set as appropriate in accordance with actual use conditions, for example.

As described above, according to Embodiment 1, the expansion device 602 is provided upstream of the refrigerant cooler 603 such that the refrigerant, reduced in pressure and temperature by the expansion device 602, flows into the refrigerant cooler 603. Before flowing through the refrigerant cooler 603, the refrigerant is reduced to a lower pressure by the expansion device 602. Its evaporating temperature in the refrigerant cooler 603 accordingly decreases. Such a configuration achieves a lower evaporating temperature in the refrigerant cooler than the related-art configuration in which the expansion device is provided downstream of the refrigerant cooler. Therefore, the configuration according to Embodiment 1 achieves a greater difference in temperature between the controller 118 and the refrigerant flowing through the refrigerant cooler 603 than the related-art configuration, thus increasing the efficiency of heat exchange. Consequently, a small amount of refrigerant can achieve a necessary cooling capacity.

Although a large amount of refrigerant has to be diverted to achieve the necessary cooling capacity in the related-art configuration, the amount of refrigerant to be diverted to the bypass pipe in Embodiment 1 can be reduced by an amount corresponding to an increase in heat exchange efficiency of the refrigerant cooler 603. Since a sufficient flow rate of the refrigerant through the refrigerant circuit can be achieved, therefore, the cooling or heating performance of the air-conditioning apparatus can be maintained.

In addition, since the expansion device 602 is provided not downstream of the refrigerant cooler 603 but upstream of the refrigerant cooler 603, the configuration of the refrigerant circuit can be simplified.

Although the air-conditioning apparatus 500 according to Embodiment 1 has the above-described exemplary configuration in which the number of heat source side units 100 is one and the number of load side units 300 is two, the apparatus may include any number of heat source side units and any number of load side units. In Embodiment 1, the case where the present invention is applied to the air-conditioning apparatus 500 including the load side units 300 that can be switched between the cooling operation and the heating operation and can be operated in either one of these operations has been described as an example. The present invention can be applied to any other apparatuses. Examples of the other apparatuses, to which the present invention can be applied, include a refrigeration cycle apparatus that heats a load with capacity supply and an apparatus in which a refrigerant circuit is configured by using a refrigeration cycle, such as a refrigeration cycle system.

In Embodiment 2, an air-conditioning apparatus capable of performing a cooling and heating mixed operation will be described as an example of another apparatus to which the present invention can be applied.

Embodiment 2

Figure 7:
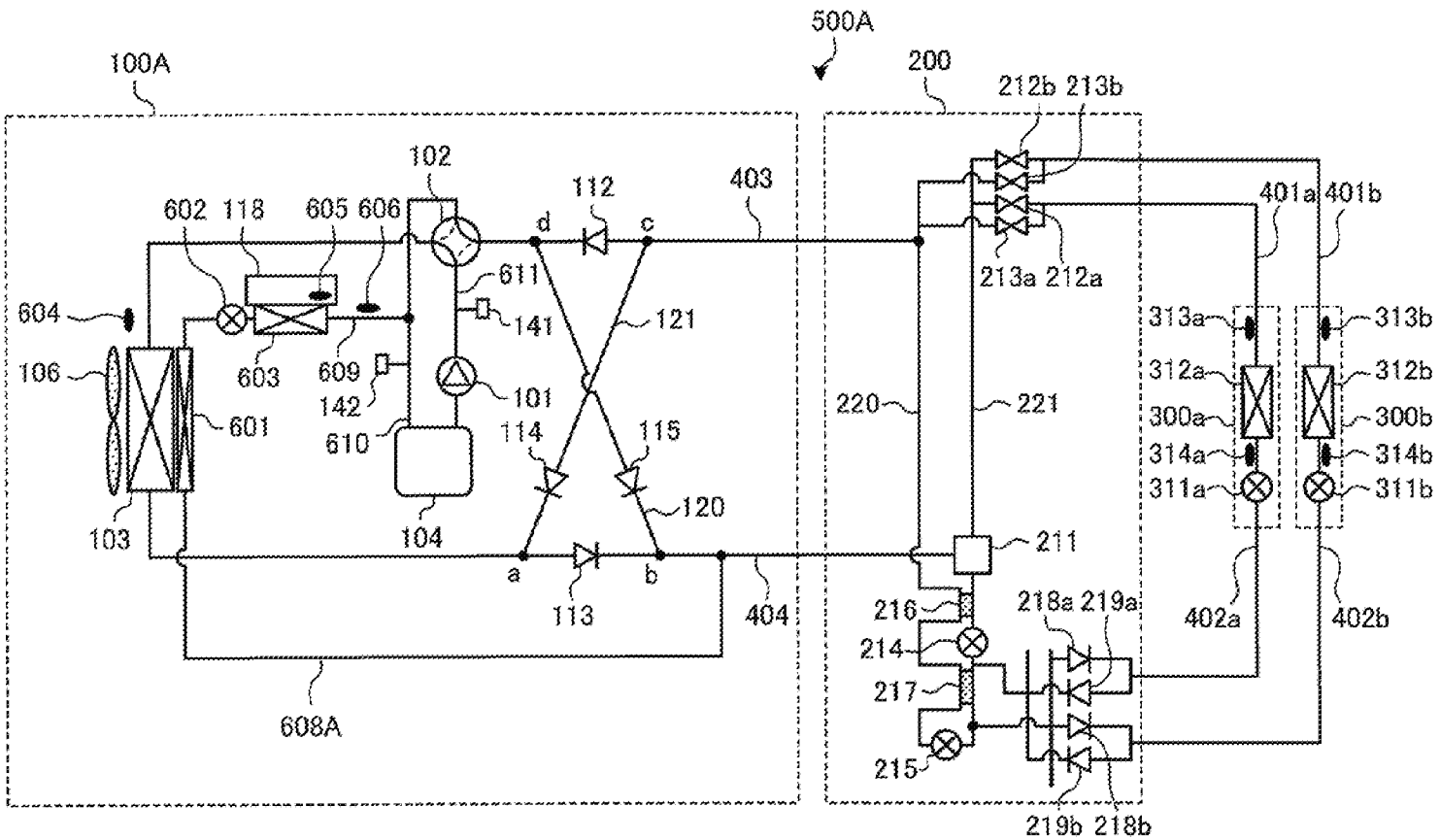
FIG. 7 is a schematic diagram illustrating an exemplary configuration of a refrigerant circuit of an air-conditioning apparatus 500A according to Embodiment 2 of the present invention.

FIG. 7 is a schematic diagram illustrating an exemplary configuration of a refrigerant circuit of an air-conditioning apparatus 500A according to Embodiment 2 of the present invention. The following description will be focused on the difference between the air-conditioning apparatus 500A according to Embodiment 2 and the air-conditioning apparatus 500 according to Embodiment 1 illustrated in FIG. 1.

The air-conditioning apparatus 500A according to Embodiment 2 includes a relay unit 200, and is configured such that the relay unit 200 is provided between the heat source side unit 100 and the load side units 300 in the air-conditioning apparatus 500 according to Embodiment 1 illustrated in FIG. 1. The load side units 300 in Embodiment 2 have the same configuration as that in Embodiment 1.

In Embodiment 2, the relay unit 200 is connected to a heat source side unit 100A by two pipes (a low-pressure pipe 403 and a high-pressure pipe 404), and is connected to the load side units 300*a* and 300*b* by the gas branch pipe 401*a*, the liquid branch pipe 402*a*, the gas branch pipe 401*b*, and the liquid branch pipe 402*b*.

The heat source side unit 100A in Embodiment 2 further includes a check valve 112, a check valve 113, a check valve 114, a check valve 115, a first connecting pipe 120, and a second connecting pipe 121 in addition to the components included in the heat source side unit 100 in Embodiment 1. The check valve 112, the check valve 113, the check valve 114, the check valve 115, the first connecting pipe 120, and the second connecting pipe 121 constitute a flow direction device in the present invention.

The first connecting pipe 120 is a pipe that connects the high-pressure pipe 404 downstream of the check valve 113 to the low-pressure pipe 403 downstream of the check valve 112. The second connecting pipe 121 is a pipe that connects the high-pressure pipe 404 upstream of the check valve 113 to the low-pressure pipe 403 upstream of the check valve 112.

As illustrated in FIG. 7, the second connecting pipe 121 and the high-pressure pipe 404 join at a junction a. The first connecting pipe 120 and the high-pressure pipe 404 join at a junction b (downstream of the junction a). The second connecting pipe 121 and the low-pressure pipe 403 join at a junction c. The first connecting pipe 120 and the low-pressure pipe 403 join at a junction d (downstream of the junction c).

The check valve 112, which is provided between the junction c and the junction d, allows the refrigerant to flow only in a direction from the relay unit 200 to the heat source side unit 100A. The check valve 113, which is provided between the junction a and the junction b, allows the refrigerant to flow only in a direction from the heat source side unit 100A to the relay unit 200. The check valve 115, which is provided in the first connecting pipe 120, allows the refrigerant to flow only in a direction from the junction d to the junction b. The check valve 114, which is provided in the second connecting pipe 121, allows the refrigerant to flow only in a direction from the junction c to the junction a.

Such a configuration enables the refrigerant to flow in one direction between the heat source side unit 100A and the relay unit 200 in response to either of a heating request and a cooling request from the load side unit 300. In other words, the refrigerant flows through the high-pressure pipe 404 in the direction from the heat source side unit 100A to the relay unit 200, and flows through the low-pressure pipe 403 in the direction from the relay unit 200 to the heat source side unit 100A.

The heat source side unit 100A includes a bypass pipe 608A instead of the bypass pipe 608 in Embodiment 1. The bypass pipe 608A differs from the bypass pipe 608 in Embodiment 1 in the position of one end connected to the high-pressure side. The bypass pipe 608 in Embodiment 1 is connected to the high-pressure pipe 611 through which the high-pressure refrigerant discharged from the compressor 101 flows, whereas the bypass pipe 608A in Embodiment 2 is connected to the high-pressure pipe 404, which extends from the heat source side heat exchanger 103 toward the expansion devices 311, downstream of the junction b. Except for the above-described difference, the route of the bypass pipe 608A and the devices arranged in the bypass pipe 608A are the same as that of and those in the bypass pipe 608 in Embodiment 1.

The relay unit 200 will now be described.

[Relay Unit 200]

The relay unit 200 switches between refrigerant flow directions in accordance with operation states of the load side units 300 so that low-temperature refrigerant is supplied to the load side unit 300 performing the cooling operation and high-temperature refrigerant is supplied to the load side unit 300 performing the heating operation. In FIG. 7, some of the components included in the relay unit 200 have a letter "a" or "b" after their reference sign. The letter "a" or "b" added to the reference sign represents that the relevant component is connected to the "load side unit 300*a*" or the "load side unit 300*b*". In the following description, the letter "a" or "b" added to the reference sign may be omitted. Although the letter "a" or "b" may be omitted in the following description, the relay unit 200 includes those components connected to the "load side unit 300*a*" and the "load side unit 300*b*".

The relay unit 200 includes a gas-liquid separator 211, first on-off valves 212 (a first on-off valve 212*a*, a first on-off valve 212*b*), second on-off valves 213 (a second on-off valve 213*a*, a second on-off valve 213*b*), a first expansion device 214, a second expansion device 215, a first refrigerant heat exchanger 216, and a second refrigerant heat exchanger 217. The relay unit 200 further includes a connecting pipe 220 that branches off from a pipe located downstream of a primary side (where the refrigerant leaving the first expansion device 214 flows) of the second refrigerant heat exchanger 217 and that is connected to the low-pressure pipe 403.

The gas-liquid separator 211, which is provided in the high-pressure pipe 404, has a function of separating two-phase refrigerant coming from the high-pressure pipe 404 into gas refrigerant and liquid refrigerant. The gas refrigerant separated by the gas-liquid separator 211 is supplied to the first on-off valves 212 through a connecting pipe 221, and the liquid refrigerant is supplied to the first refrigerant heat exchanger 216.

The first on-off valves 212, which are used to control refrigerant supply to the load side unit 300 in each operation mode, are arranged between the connecting pipe 221 and the gas branch pipes 401*a* and 401*b*. Specifically, each of the first on-off valves 212 is connected at one end to the gas-liquid separator 211, and is connected at the other end to the load side heat exchanger 312 in the load side unit 300. The first on-off valve 212 is controlled to open or close to allow or block the flow of the refrigerant.

The second on-off valves 213, which are also used to control refrigerant supply to the load side unit 300 in each operation mode, are arranged between the low-pressure pipe 403 and the gas branch pipes 401*a* and 401*b*. Specifically, each of the second on-off valves 213 is connected at one end to the low-pressure pipe 403, and is connected at the other end to the load side heat exchanger 312 in the load side unit 300. The second on-off valve 213 is controlled to open or close to allow or block the flow of the refrigerant.

The first expansion device 214 is provided in a pipe connecting the gas-liquid separator 211 to the liquid branch pipes 402*a* and 402*b*. Specifically, the first expansion device 214 is provided between the first refrigerant heat exchanger 216 and the second refrigerant heat exchanger 217. The first expansion device 214, functioning as a pressure reducing valve or an expansion valve, reduces the pressure of the refrigerant to expand the refrigerant. The first expansion device 214 may include a component whose opening degree is variably adjustable, for example, an accurate flow control device, such as an electronic expansion valve, or an inexpensive refrigerant flow control unit, such as a capillary tube.

The second expansion device 215 is provided in the connecting pipe 220, and is located between the second refrigerant heat exchanger 217 and the second on-off valves 213. The second expansion device 215, functioning as a pressure reducing valve or an expansion valve, reduces the pressure of the refrigerant to expand the refrigerant. Like the first expansion device 214, the second expansion device 215 may include a component whose opening degree is variably adjustable, for example, an accurate flow control device, such as an electronic expansion valve, or an inexpensive refrigerant flow control unit, such as a capillary tube.

The first refrigerant heat exchanger 216 exchanges heat between the refrigerant flowing through its primary side (where the liquid refrigerant separated by the gas-liquid separator 211 flows) and the refrigerant flowing through its secondary side (where the refrigerant leaving the second refrigerant heat exchanger 217 after passing through the second expansion device 215 flows through the connecting pipe 220).

The second refrigerant heat exchanger 217 exchanges heat between the refrigerant flowing through its primary side (downstream of the first expansion device 214) and the refrigerant flowing through its secondary side (downstream of the second expansion device 215).

The arrangement of the first expansion device 214, the second expansion device 215, the first refrigerant heat exchanger 216, and the second refrigerant heat exchanger 217 in the relay unit 200 allows the first refrigerant heat exchanger 216 and the second refrigerant heat exchanger 217 to exchange heat between the refrigerant flowing through a main circuit (the primary side) and the refrigerant flowing through the connecting pipe 220 (the secondary side), thus subcooling the refrigerant flowing through the main circuit. The opening degree of the second expansion device 215 is used to adjust the amount of refrigerant to be diverted to the secondary side so that proper subcooling can be achieved at a primary-side outlet of the second refrigerant heat exchanger 217.

Although the configuration in which the controller 118 controlling the operation of the air-conditioning apparatus 500A is provided in the heat source side unit 100A is illustrated as an example in FIG. 7, the controller 118 may be provided in any of the relay unit 200 and the load side units 300. Furthermore, the controller 118 may be provided outside the heat source side unit 100A, the relay unit 200, and the load side units 300. In addition, the controller 118 may be divided into a plurality of controllers on the basis of functions, and the controller may be provided in each of the heat source side unit 100A, the relay unit 200, and the load side units 300. In this case, the controllers may be connected to each other in a wireless or wired manner for communication.

Operations performed by the air-conditioning apparatus 500A will now be described.

The air-conditioning apparatus 500A receives a cooling request or a heating request from, for example, a remote controller provided in, for example, an indoor space. The air-conditioning apparatus 500A performs an air-conditioning operation in any of four operation modes in response to the request. The four operation modes are as follows:

(1) a cooling only operation mode in which all of the load side units 300 are required to perform the cooling operation;

(2) a cooling main operation mode in which a cooling operation request and a heating operation request have been received and it is determined that a load to be processed by the cooling operation is large;

(3) a heating main operation mode in which a cooling operation request and a heating operation request have been received and it is determined that a heating load is large; and (4) a heating only operation mode in which all of the load side units 300 are required to perform the heating operation.

The operation modes will now be described.

[Cooling Only Operation Mode]

Figure 8:
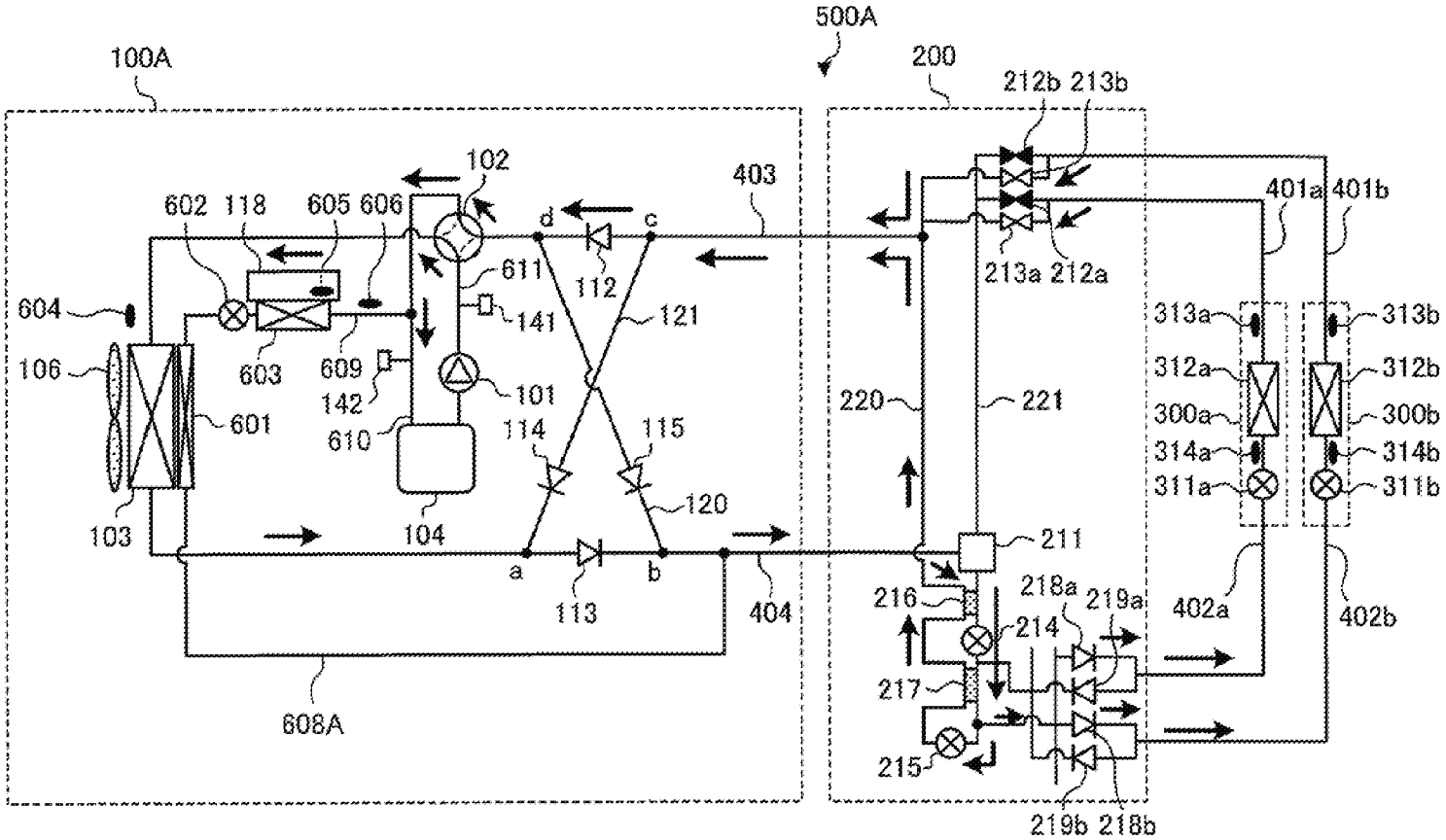
FIG. 8 is a diagram illustrating a flow of the refrigerant in a cooling only operation mode of the air-conditioning apparatus 500A according to Embodiment 2 of the present invention.

FIG. 8 is a diagram illustrating a flow of the refrigerant in the cooling only operation mode of the air-conditioning apparatus 500A according to Embodiment 2 of the present invention. An operation of the air-conditioning apparatus 500A in the cooling only operation mode will now be described with reference to FIG. 8. For the first on-off valves 212 and the second on-off valves 213 in FIG. 8, each filled symbol represents a closed state, and each outlined symbol represents an open state. The same applies to the following figures, which will be described later.

The compressor 101 compresses low-temperature, low-pressure refrigerant into high-temperature, high-pressure gas refrigerant and discharges the refrigerant. The high-temperature, high-pressure gas refrigerant discharged from the compressor 101 passes through the four-way switching valve 102, and flows to the heat source side heat exchanger 103. Since the heat source side heat exchanger 103 functions as a condenser, the refrigerant exchanges heat with ambient air and thus condenses and liquefies. The liquid refrigerant leaving the heat source side heat exchanger 103 flows through the high-pressure pipe 404, passes through the check valve 113, and flows out of the heat source side unit 100A.

The high-pressure liquid refrigerant leaving the heat source side unit 100A passes through the gas-liquid separator 211 in the relay unit 200, and flows into the primary side (refrigerant inflow side) of the first refrigerant heat exchanger 216. The liquid refrigerant that has flowed into the primary side of the first refrigerant heat exchanger 216 is subcooled by the refrigerant flowing through the secondary side (refrigerant outflow side) of the first refrigerant heat exchanger 216. The liquid refrigerant whose degree of subcooling has increased is throttled to an intermediate pressure by the first expansion device 214. After that, the liquid refrigerant flows into the second refrigerant heat exchanger 217, where the degree of subcooling of the liquid refrigerant is further increased. Then, the flow of the liquid refrigerant divides into two streams. One of the streams passes through a check valve 218*a* and a check valve 218*b* and then flows out of the relay unit 200. The other stream flows to the second expansion device 215.

The liquid refrigerant leaving the relay unit 200 flows into the load side units 300*a* and 300*b*. The liquid refrigerant that has flowed into the load side units 300*a* and 300*b* is throttled into low-temperature, two-phase gas-liquid refrigerant by the expansion devices 311*a* and 311*b*. The low-temperature, two-phase gas-liquid refrigerant flows into the load side heat exchangers 312*a* and 312*b*. Since the load side heat exchangers 312*a* and 312*b* each function as an evaporator, the refrigerant exchanges heat with ambient air and thus evaporates and gasifies. At this time, the refrigerant removes heat from the ambient air, thus cooling the indoor space. After that, the refrigerant leaving the load side heat exchangers 312*a* and 312*b* flows through the gas branch pipes 401*a* and 401*b*, flows out of the load side unit 300*a* and 300*b*, and flows into the relay unit 200.

The refrigerant that has flowed into the relay unit 200 passes through the second on-off valves 213*a* and 213*b*, joins the refrigerant that has flowed through the connecting pipe 220 after passing through the first expansion device 214 and the second expansion device 215 for subcooling in the second refrigerant heat exchanger 217. Then, the refrigerant flows into the low-pressure pipe 403.

The refrigerant flowing through the low-pressure pipe 403 flows out of the relay unit 200 and then returns to the heat source side unit 100A. The gas refrigerant that has returned to the heat source side unit 100A passes through the check valve 112, the four-way switching valve 102, and the accumulator 104, and is then sucked again into the compressor 101. The above-described flow allows the air-conditioning apparatus 500A to implement the cooling only operation mode.

[Cooling Main Operation Mode]

Figure 9:
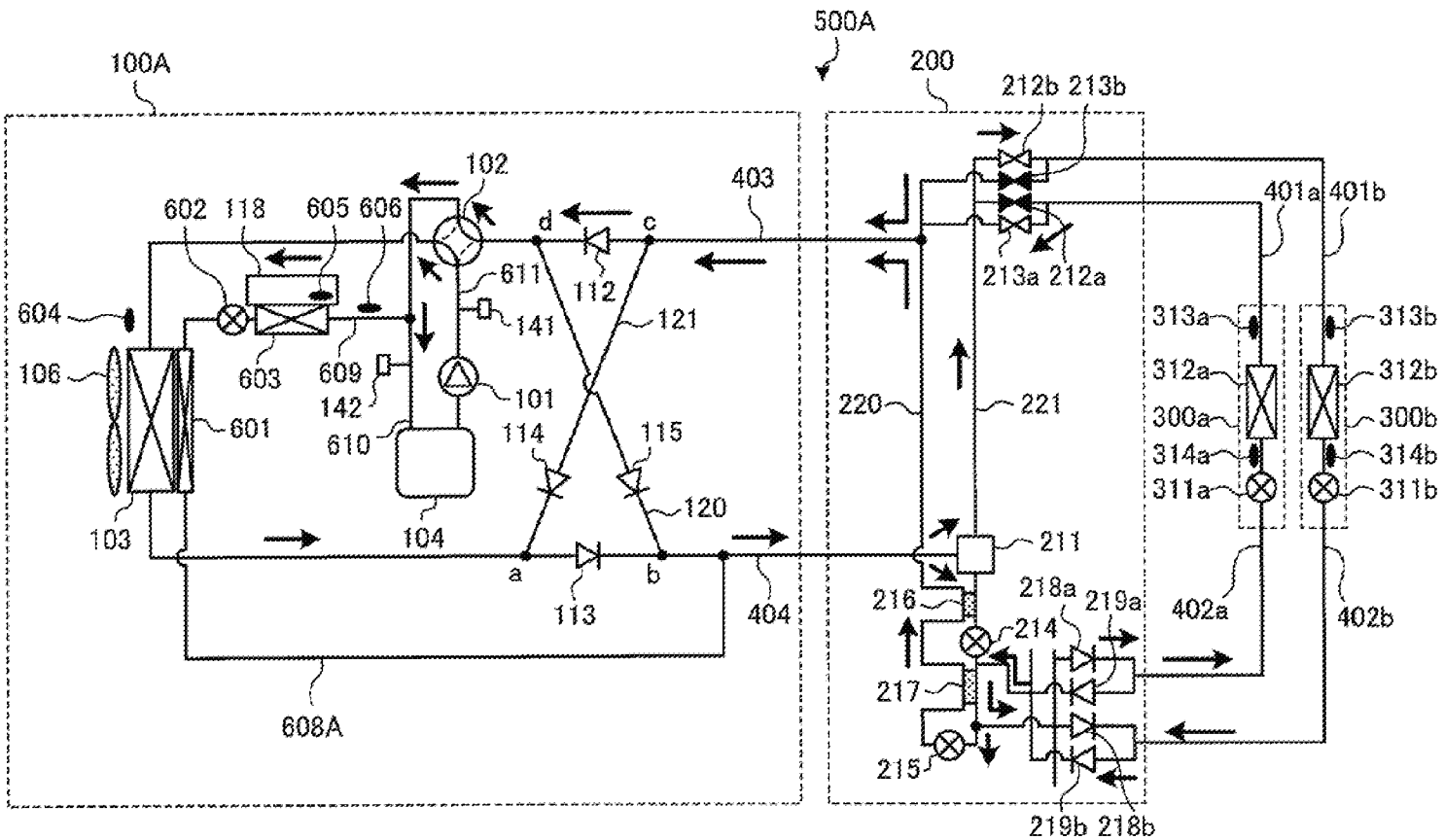
FIG. 9 is a diagram illustrating a flow of the refrigerant in a cooling main operation mode of the air-conditioning apparatus 500A according to Embodiment 2 of the present invention.

FIG. 9 is a diagram illustrating a flow of the refrigerant in the cooling main operation mode of the air-conditioning apparatus 500A according to Embodiment 2 of the present invention. In the case where the load side units 300 perform different operations, or the cooling operation and the heating operation, and a cooling load is larger than a heating load, the apparatus operates in the cooling main operation mode. An operation of the air-conditioning apparatus 500A in the cooling main operation mode will be described with reference to FIG. 9. The operation in the cooling main operation mode will now be described on the assumption that the load side unit 300*a* performs cooling and the load side unit 300*b* performs heating.

The compressor 101 compresses low-temperature, low-pressure refrigerant into high-temperature, high-pressure gas refrigerant and discharges the refrigerant. The high-temperature, high-pressure gas refrigerant discharged from the compressor 101 passes through the four-way switching valve 102 and flows into the heat source side heat exchanger 103. Since the heat source side heat exchanger 103 functions as a condenser, the refrigerant exchanges heat with the ambient air and thus condenses into a two-phase state. Then, the two-phase gas-liquid refrigerant leaving the heat source side heat exchanger 103 flows through the high-pressure pipe 404, passes through the check valve 113, and flows out of the heat source side unit 100A.

The two-phase gas-liquid refrigerant leaving the heat source side unit 100A flows into the gas-liquid separator 211 in the relay unit 200. The two-phase gas-liquid refrigerant that has flowed into the gas-liquid separator 211 is separated into gas refrigerant and liquid refrigerant by the gas-liquid separator 211. The gas refrigerant flows out of the gas-liquid separator 211 and flows into the connecting pipe 221. The gas refrigerant that has flowed into the connecting pipe 221 passes through the first on-off valve 212*b*, flows through the gas branch pipe 401*b*, and flows into the load side unit 300*b*. The gas refrigerant that has flowed into the load side unit 300*b* transfers heat to the ambient air in the load side heat exchanger 312*b* to heat an air-conditioned space, and thus condenses and liquefies. Then, the refrigerant flows out of the load side heat exchanger 312*b*. The liquid refrigerant leaving the load side heat exchanger 312*b* is throttled to an intermediate pressure by the expansion device 311*b*.

The intermediate-pressure liquid refrigerant throttled by the expansion device 311*b* flows through the liquid branch pipe 402*b*, and passes through a check valve 219*b*. The liquid refrigerant leaving the check valve 219*b* joins the liquid refrigerant that has passed through the first refrigerant heat exchanger 216 and the first expansion device 214 after being separated by the gas-liquid separator 211. Then, the refrigerant flows into the second refrigerant heat exchanger 217. The liquid refrigerant that has flowed into the second refrigerant heat exchanger 217 is further increased in degree of subcooling and then flows out of the second refrigerant heat exchanger 217. The flow of the refrigerant leaving the second refrigerant heat exchanger 217 divides into two streams. One of the streams passes through the check valve 218*a*, flows through the liquid branch pipe 402*a*, and flows out of the relay unit 200. The other stream flows to the second expansion device 215. The liquid refrigerant leaving the relay unit 200 flows into the load side unit 300*a*. The liquid refrigerant that has flowed into the load side unit 300*a* is throttled into low-temperature, two-phase gas-liquid refrigerant by the expansion device 311*a*. The low-temperature, two-phase gas-liquid refrigerant flows into the load side heat exchanger 312*a*, where the refrigerant removes heat from the ambient air to cool the air-conditioned space and thus evaporates and gasifies. Then, the refrigerant flows out of the load side heat exchanger 312*a*.

The gas refrigerant leaving the load side heat exchanger 312*a* flows through the gas branch pipe 401*a*, flows out of the load side unit 300*a*, and then flows into the relay unit 200. The refrigerant that has flowed into the relay unit 200 passes through the second on-off valve 213*a*. The refrigerant that has passed through the second on-off valve 213*a* joins the refrigerant that has flowed through the connecting pipe 220 after passing through the first expansion device 214 and the second expansion device 215 for subcooling in the second refrigerant heat exchanger 217. Then, the refrigerant flows into the low-pressure pipe 403.

The refrigerant flowing through the low-pressure pipe 403 flows out of the relay unit 200 and then returns to the heat source side unit 100A. The gas refrigerant that has returned to the heat source side unit 100A passes through the check valve 112, the four-way switching valve 102, and the accumulator 104, and is then sucked again into the compressor 101. The above-described flow allows the air-conditioning apparatus 500A to implement the cooling main operation mode.

[Heating Only Operation Mode]

Figure 10:
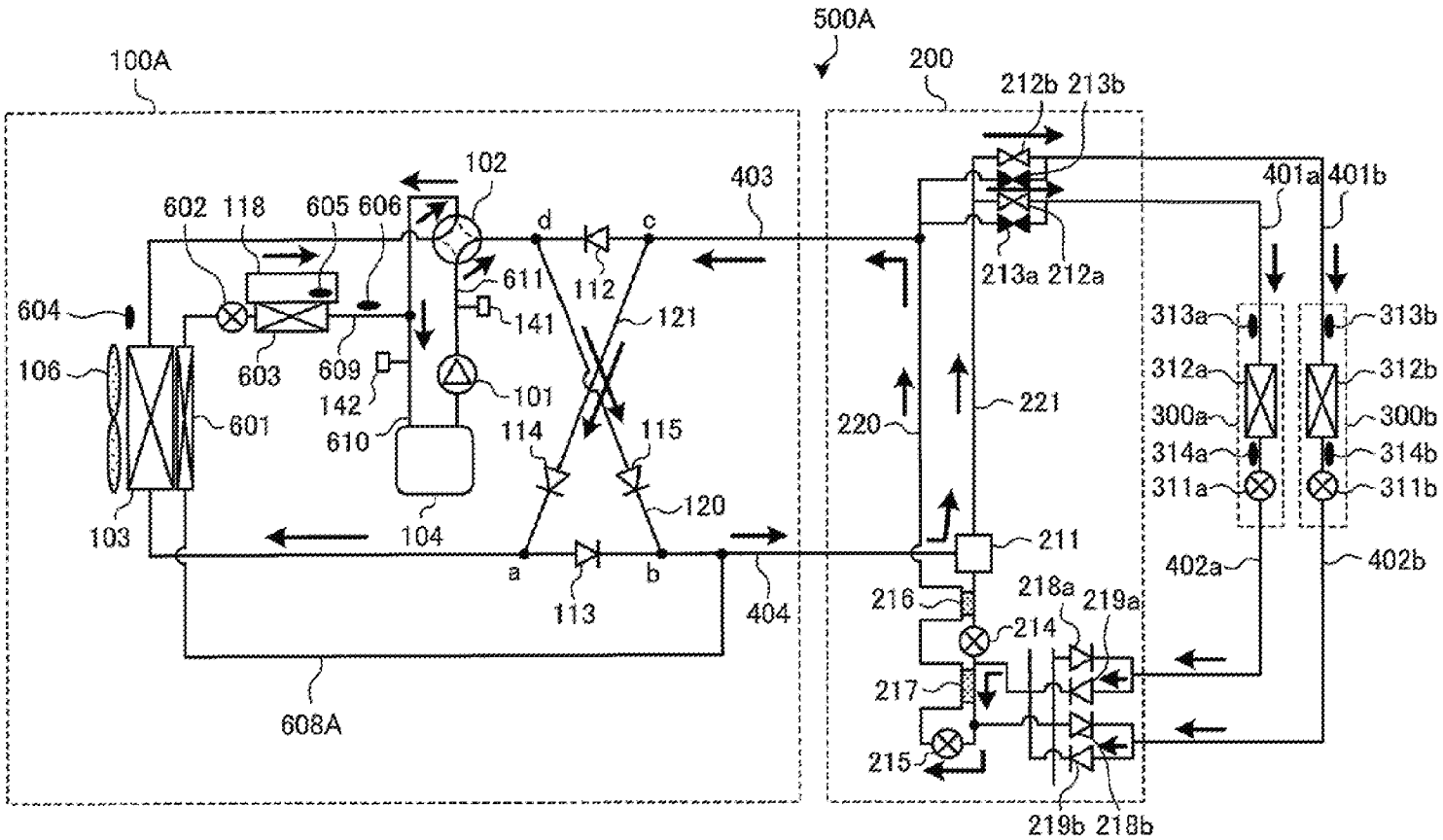
FIG. 10 is a refrigerant circuit diagram illustrating a flow of the refrigerant in a heating only operation mode of the air-conditioning apparatus 500A according to Embodiment 2 of the present invention.

FIG. 10 is a refrigerant circuit diagram illustrating a flow of the refrigerant in the heating only operation mode in the air-conditioning apparatus 500A according to Embodiment 2 of the present invention. An operation of the air-conditioning apparatus 500A in the heating only operation mode will be described with reference to FIG. 10.

The compressor 101 compresses low-temperature, low-pressure refrigerant into high-temperature, high-pressure gas refrigerant and discharges the refrigerant. The high-temperature, high-pressure gas refrigerant discharged from the compressor 101 passes through the four-way switching valve 102 and the check valve 115, and flows into the high-pressure pipe 404. The refrigerant then flows out of the heat source side unit 100A. The high-temperature, high-pressure gas refrigerant leaving the heat source side unit 100A passes through the gas-liquid separator 211 in the relay unit 200, flows through the connecting pipe 221, and passes through the first on-off valves 212*a* and 212*b*. The high-temperature, high-pressure gas refrigerant that has passed through the first on-off valves 212*a* and 212*b* flows through the gas branch pipes 401*a* and 401*b* into the load side units 300*a* and 300*b*.

The gas refrigerant that has flowed into the load side units 300*a* and 300*b* flows into the load side heat exchangers 312*a* and 312*b*. Since the load side heat exchangers 312*a* and 312*b* each function as a condenser, the refrigerant exchanges heat with the ambient air and thus condenses and liquefies. At this time, the refrigerant transfers heat to the ambient air, thus heating the air-conditioned space, or the indoor space. Then, the liquid refrigerant flows out of the load side heat exchangers 312*a* and 312*b*, and is reduced in pressure by the expansion devices 311*a* and 311*b*.

The liquid refrigerant reduced in pressure by the expansion devices 311*a* and 311*b* flows through the liquid branch pipes 402*a* and 402*b*, flows out of the load side units 300*a* and 300*b*, and then flows into the relay unit 200. The liquid refrigerant that has flowed into the relay unit 200 passes through a check valve 219*a* and the check valve 219*b*, and flows into the pipe between the first expansion device 214 and the second refrigerant heat exchanger 217. The refrigerant passes through the second refrigerant heat exchanger 217 and then passes through the second expansion device 215. The refrigerant flows through the connecting pipe 220, and flows into the low-pressure pipe 403.

The refrigerant flowing through the low-pressure pipe 403 flows out of the relay unit 200 and then returns to the heat source side unit 100A. The refrigerant that has returned to the heat source side unit 100A flows through the second connecting pipe 121, passes through the check valve 114, and flows into the heat source side heat exchanger 103. Since the heat source side heat exchanger 103 functions as an evaporator, the refrigerant exchanges heat with the ambient air and thus evaporates and gasifies. After that, the refrigerant leaving the heat source side heat exchanger 103 passes through the four-way switching valve 102, and flows into the accumulator 104. The compressor 101 sucks the refrigerant in the accumulator 104 and circulates the refrigerant through the refrigerant circuit, thus establishing the refrigeration cycle. The above-described flow allows the air-conditioning apparatus 500A to implement the heating only operation mode.

[Heating Main Operation Mode]

Figure 11:
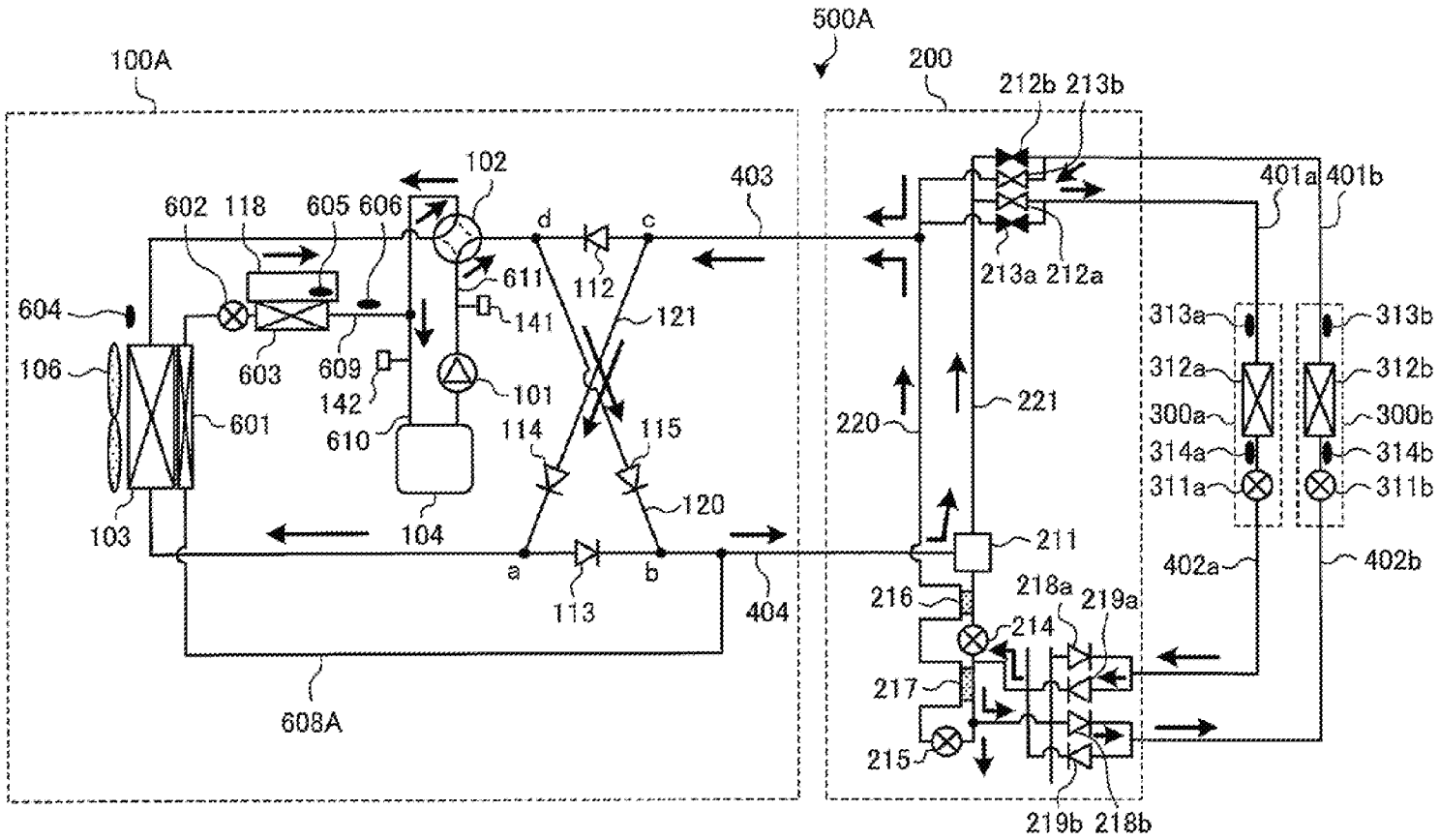
FIG. 11 is a refrigerant circuit diagram illustrating a flow of the refrigerant in a heating main operation mode of the air-conditioning apparatus 500A according to Embodiment 2 of the present invention.

FIG. 11 is a refrigerant circuit diagram illustrating a flow of the refrigerant in the heating main operation mode of the air-conditioning apparatus 500A according to Embodiment 2 of the present invention. An operation of the air-conditioning apparatus 500A in the heating main operation mode will be described with reference to FIG. 11. The heating main operation mode implemented in response to a heating request from the load side unit 300*a* and a cooling request from the load side unit 300*b* will now be described. The flow of the refrigerant from the compressor 101 in the heat source side unit 100A to the load side unit 300*a* required to perform heating is the same as that in the heating only operation mode, and a description of this flow is omitted.

The liquid refrigerant flowing through the liquid branch pipe 402*a* after passing through the load side unit 300*a* required to perform heating passes through the check valve 219*a*. Then, the refrigerant is subcooled by the second refrigerant heat exchanger 217, and flows out of the second refrigerant heat exchanger 217. The flow of the liquid refrigerant leaving the second refrigerant heat exchanger 217 divides into two streams. One of the streams passes through the check valve 218*b*, flows through the liquid branch pipe 402*b*, and flows into the load side unit 300*b* required to perform cooling. The other stream flows to the second expansion device 215. The refrigerant that has flowed into the load side unit 300*b* is reduced in pressure by the expansion device 311*b*. The refrigerant reduced in pressure by the expansion device 311*b* flows into the load side heat exchanger 312*b*.

Since the load side heat exchanger 312*b* functions as an evaporator, the refrigerant exchanges heat with the ambient air and thus evaporates and gasifies. At this time, the refrigerant removes heat from the ambient air, thus cooling the indoor space. After that, the gas refrigerant leaving the load side heat exchanger 312*b* flows through the gas branch pipe 401*b*, flows out of the load side unit 300*b*, and flows into the relay unit 200. The refrigerant that has flowed into the relay unit 200 passes through the second on-off valve 213*b*. The refrigerant that has passed through the second on-off valve 213*b* joins the refrigerant that has flowed through the connecting pipe 220 after passing through the second expansion device 215 for subcooling in the second refrigerant heat exchanger 217. Then, the refrigerant flows into the low-pressure pipe 403.

The refrigerant flowing through the low-pressure pipe 403 flows out of the relay unit 200 and then returns to the heat source side unit 100A. The refrigerant that has returned to the heat source side unit 100A passes through the check valve 114 and flows into the heat source side heat exchanger 103. Since the heat source side heat exchanger 103 functions as an evaporator, the refrigerant exchanges heat with the ambient air and thus evaporates and gasifies. After that, the refrigerant leaving the heat source side heat exchanger 103 passes through the four-way switching valve 102, and flows into the accumulator 104. The compressor 101 sucks the refrigerant in the accumulator 104 and circulates the refrigerant through the circuit, thus establishing the refrigeration cycle. The above-described flow allows the air-conditioning apparatus 500A to implement the heating main operation mode.

The present invention can be applied to the air-conditioning apparatus 500A that implements the above-described operation modes. In other words, the refrigerant cooling control illustrated in the flowchart of FIG. 5 can be used in the air-conditioning apparatus 500A. Thus, the air-conditioning apparatus 500A according to Embodiment 2 can offer the same advantages as those in Embodiment 1 described above.

As described above, the high-pressure side end of the two ends of the bypass pipe 608 in Embodiment 1 is connected to the high-pressure pipe 611, whereas the high-pressure side end of the bypass pipe 608A in Embodiment 2 is connected to the high-pressure pipe 404 downstream of the junction b. Therefore, a flow of the refrigerant for the refrigerant cooling control in Embodiment 2 slightly differs from that in Embodiment 1. The flow of the refrigerant for the refrigerant cooling control will now be described. Since the refrigerant for the refrigerant cooling control flows in the same way in any operation mode, the flow of the refrigerant will be described with reference to a diagram illustrating the flow of the refrigerant in the cooling main operation mode.

Figure 12:
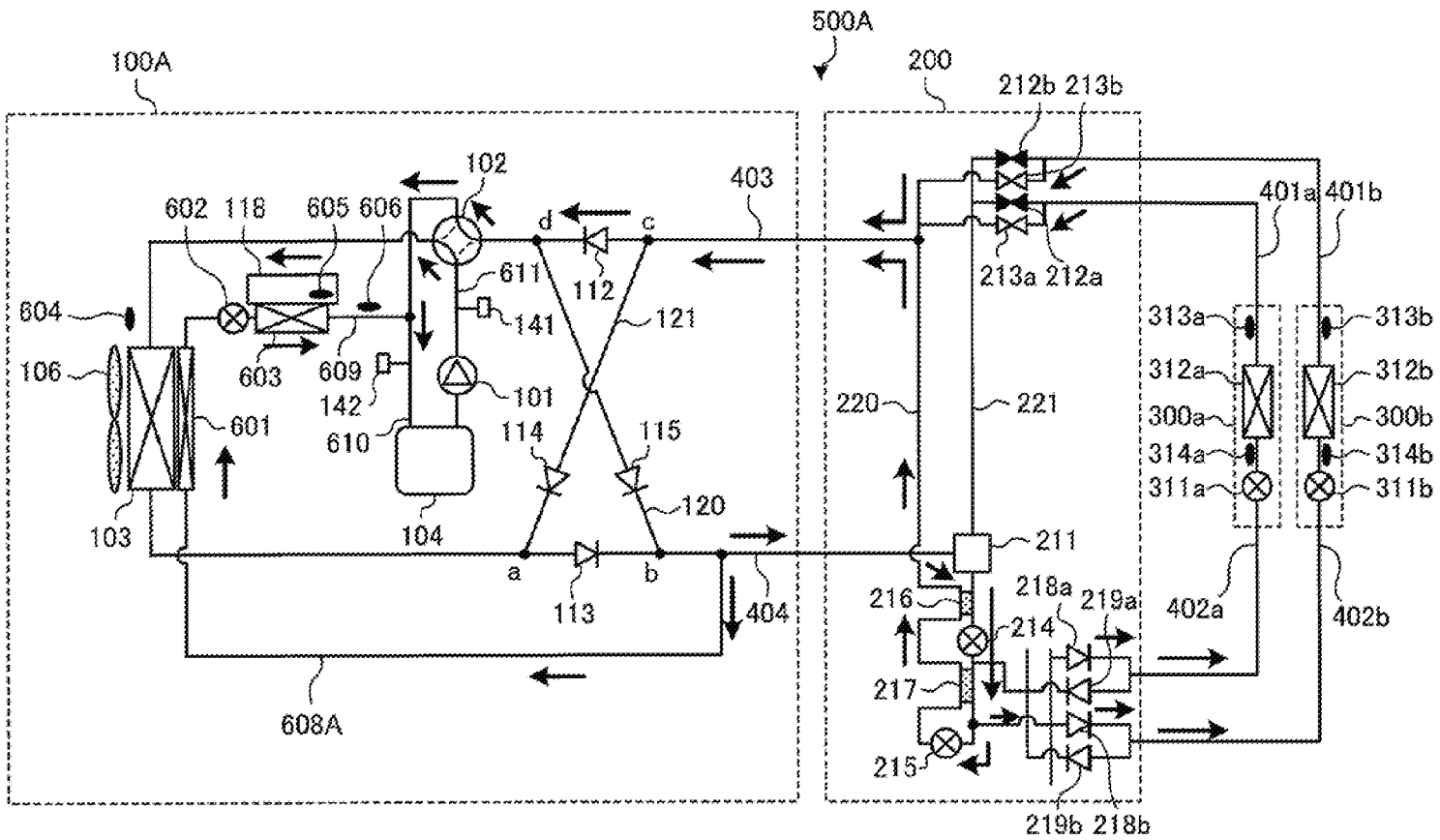
FIG. 12 is a refrigerant circuit diagram illustrating a flow of the refrigerant for the refrigerant cooling control in the cooling only operation mode of the air-conditioning apparatus 500A according to Embodiment 2 of the present invention.

FIG. 12 is a refrigerant circuit diagram illustrating the flow of the refrigerant for the refrigerant cooling control in the cooling only operation mode of the air-conditioning apparatus 500A according to Embodiment 2 of the present invention.

In Embodiment 2, when the expansion device 602 is opened, part of the refrigerant flowing from the junction b to the relay unit 200 in the high-pressure pipe 404 is diverted to the bypass pipe 608A. The refrigerant diverted to the bypass pipe 608A flows in the same way as the refrigerant flowing through the bypass pipe 608 in Embodiment 1. Specifically, the refrigerant diverted to the bypass pipe 608A flows into the precooling heat exchanger 601. The liquid refrigerant that has flowed into the precooling heat exchanger 601 exchanges heat with air from the heat source side fan 106, so that the refrigerant is cooled. The liquid refrigerant cooled and reduced in pressure by the precooling heat exchanger 601 is further reduced to a lower pressure by the expansion device 602. Then, the refrigerant flows into the refrigerant cooler 603. In the refrigerant cooler 603, the refrigerant exchanges heat with the controller 118 and thus evaporates. At this time, the refrigerant removes heat from the controller 118 and thus cools the controller 118. The refrigerant turns into gas refrigerant or two-phase refrigerant by cooling the controller 118. The refrigerant flows through the low-pressure pipe 610, and flows into the accumulator 104.

Although the air-conditioning apparatus 500A according to Embodiment 2 has the above-described exemplary configuration in which the number of heat source side units 100A is one, the number of relay units 200 is one, and the number of load side units 300 is two, the apparatus may include any number of heat source side units, any number of relay units, and any number of load side units.

Although Embodiments 1 and 2 have been described on the assumption that the refrigeration cycle apparatus is the air-conditioning apparatus, the refrigeration cycle apparatus may be a cooling apparatus that cools, for example, a refrigerator/freezer warehouse.

The invention claimed is:

1. A refrigeration cycle apparatus comprising:

a refrigerant circuit configured to circulate refrigerant, the refrigerant circuit including a compressor, a heat source side heat exchanger, a first expansion device, and a load side heat exchanger;

a controller configured to control the refrigerant circuit;

a high-pressure pipe having a first part extending from the compressor to the heat source side heat exchanger and a second part extending from the heat source side heat exchanger to the first expansion device provided;

a low-pressure pipe extending from the load side heat exchanger to a suction side of the compressor;

a bypass pipe having a first end that branches off from the first part of the high-pressure pipe extending from the compressor to the heat source side heat exchanger and a second end that is directly connected to the low-pressure pipe on the suction side of the compressor;

a precooling heat exchanger provided in the bypass pipe and configured to cool the refrigerant diverted to the bypass pipe;

a second expansion device in the bypass pipe and configured to reduce a pressure of the refrigerant cooled by the precooling heat exchanger;

a refrigerant cooler provided in the bypass pipe and configured to cool the controller directly with the refrigerant reduced in pressure by a second expansion device;

a controller temperature sensor configured to detect a temperature of the controller; and an outdoor air temperature sensor configured to detect an outdoor air temperature, wherein the controller is configured to increase an opening degree of the second expansion device in a case where the temperature detected by the controller temperature sensor is at or above a preset start temperature, and the controller is configured to reduce the opening degree of the second expansion device in a case where the temperature detected by the controller temperature sensor is at or below the temperature detected by the outdoor air temperature sensor while the second expander is open.

2. The refrigeration cycle apparatus of claim 1, wherein the controller is configured to reduce the opening degree of the second expansion device in a case where the temperature detected by the controller temperature sensor is at or below an end temperature set lower than the start temperature while the second expansion device is open.

3. The refrigeration cycle apparatus of claim 1, wherein the controller is configured to reduce the opening degree of the second expansion device in a case where the temperature detected by the controller temperature sensor is above the temperature detected by the outdoor air temperature sensor and is at or below a preset target temperature while the second expansion device is open.

4. The refrigeration cycle apparatus of claim 1, further comprising:

a superheat-degree detection sensor configured to detect a degree of superheat at an outlet of the refrigerant cooler, wherein while the second expansion device is open, the controller is configured to control the opening degree of the second expansion device based on a comparison of the degree of superheat detected by the superheat-degree detection sensor with a previously set value.

5. The refrigeration cycle apparatus of claim 4, wherein the controller is configured to increase the opening degree of the second expansion device in a case where the temperature detected by the controller temperature sensor is above a preset target temperature and the degree of superheat detected by the superheat-degree detection sensor is above the previously set value while the second expansion device is open.

6. The refrigeration cycle apparatus of claim 4, wherein the controller is configured to reduce the opening degree of the second expansion device in a case where the degree of superheat detected by the superheat-degree detection sensor is at or below the previously set value while the second expansion device is open.

7. The refrigeration cycle apparatus of claim 1, further comprising:

a flow switching valve configured to switch a flow of the refrigerant discharged from the compressor between a refrigerant flow direction to the heat source side heat exchanger and a refrigerant flow direction to the load side heat exchanger, wherein the bypass pipe has a high-pressure side end that is one of two ends of the bypass pipe and the high-pressure side end is connected to a pipe between the compressor and the flow switching valve.

8. The refrigeration cycle apparatus of claim 4, wherein the controller is configured to reduce the opening degree of the second expansion device in a case where the degree of superheat detected by the superheat-degree detection sensor is at or below a first previously set and the temperature detected by the controller temperature sensor is at or below a second previously set value while the second expansion device is open.

9. The refrigeration cycle apparatus of claim 1, wherein the precooling heat exchanger is integrated with the heat source side heat exchanger.

10. A refrigeration cycle apparatus comprising:

a refrigerant circuit configured to circulate refrigerant, the refrigerant circuit including a compressor, a heat source side heat exchanger, a first expansion device, and a load side heat exchanger;

a controller configured to control the refrigerant circuit;

a bypass pipe that branches off from a high-pressure pipe extending from the compressor to the first expansion device and that is connected to a low-pressure pipe on a suction side of the compressor;

a precooling heat exchanger provided in the bypass pipe and configured to cool the refrigerant diverted to the bypass pipe;

a second expansion device provided in the bypass pipe and configured to reduce a pressure of the refrigerant cooled by the precooling heat exchanger; and a refrigerant cooler provided in the bypass pipe and configured to cool the controller with the refrigerant reduced in pressure by the second expansion device, a controller temperature sensor configured to detect a temperature of the controller, and an outdoor air temperature sensor configured to detect an outdoor air temperature, wherein the controller is configured to increase an opening degree of the second expansion device in a case where the temperature detected by the controller temperature sensor is at or above a preset start temperature, and wherein the controller is configured to reduce the opening degree of the second expansion device is where the temperature detected by the controller temperature sensor is at or below the temperature detected by the outdoor air temperature sensor while the second expander is open.

11. The refrigeration cycle apparatus of claim 10, wherein the controller is configured to reduce the opening degree of the second expansion device in a case where the temperature detected by the controller temperature sensor is above the temperature detected by the outdoor air temperature sensor and is at or below a preset target temperature while the second expansion device is open.

* * * * *